US010090627B2

(12) United States Patent
Stull et al.

(10) Patent No.: US 10,090,627 B2
(45) Date of Patent: Oct. 2, 2018

(54) FILTERS FOR TERMINAL CRIMPING DEVICES USING ULTRASONIC SIGNALS

(71) Applicant: Tyco Electronics Corporation

(72) Inventors: David Michael Stull, Etters, PA (US); Christopher John Karrasch, Boiling Springs, PA (US); Keith Lynn Nicholas, Harrisburg, PA (US); Charles David Fry, New Bloomfield, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 541 days.

(21) Appl. No.: 13/972,584

(22) Filed: Aug. 21, 2013

(65) Prior Publication Data

US 2015/0052740 A1 Feb. 26, 2015

(51) Int. Cl.
*H01R 43/048* (2006.01)
*H01R 43/058* (2006.01)

(52) U.S. Cl.
CPC ..... *H01R 43/048* (2013.01); *H01R 43/058* (2013.01); *Y10T 29/53022* (2015.01)

(58) Field of Classification Search
CPC .... H01R 43/058; H01R 43/048; G01N 29/22; G01N 29/04; B21D 39/048
See application file for complete search history.

(56) References Cited

U.S. PATENT DOCUMENTS 3,522,577 A 8/1970 Zak
3,644,989 A 2/1972 Morby
4,288,695 A * 9/1981 Walters ..... A61B 6/032 378/159
4,799,264 A * 1/1989 Plummer ..... H04R 1/023 181/145
4,856,185 A 8/1989 Yeomans
4,934,103 A * 6/1990 Campergue ..... B24B 1/04 451/165
5,123,165 A 6/1992 Strong et al.
5,197,186 A 3/1993 Strong et al.
(Continued)

FOREIGN PATENT DOCUMENTS

CN 102770079 A 11/2012
JP 4070705 B2 4/2008
(Continued)

OTHER PUBLICATIONS

Cramer, K. E. (et al), A Method for the Verification of Wire Crimp Compression Using Ultrasonic Inspection, Research in Nondestructive Evaluation, Jan. 29, 2010, pp. 18-29, vol. 21, No. 1, Hampton, VA, USA.

(Continued)

*Primary Examiner* — Shelley Self
*Assistant Examiner* — Mohammad Yusuf

(57) ABSTRACT

A terminal crimping device includes crimp tooling comprising an anvil and a ram movable toward the anvil with a crimp zone being defined between the anvil and the ram configured to receive a wire and a terminal configured to be crimped to the wire by the crimp tooling. An ultrasonic transmitting transducer is coupled to at least one of the anvil and the ram that transmits acoustic signals through the wire and terminal. A filter is provided on at least one of the anvil and the ram in the path of the acoustic signals that affects the acoustic signals.

16 Claims, 5 Drawing Sheets

(56) References Cited

U.S. PATENT DOCUMENTS

| | | | | |
|---|---|---|---|---|
| 5,515,733 | A | 5/1996 | Lynnworth | |
| 5,570,691 | A * | 11/1996 | Wright | G01S 7/52049 600/447 |
| 6,330,831 | B1 | 12/2001 | Lynnworth et al. | |
| 7,181,942 | B2 | 2/2007 | Yost et al. | |
| 9,003,645 | B1 * | 4/2015 | Yost | H01R 43/0421 29/705 |
| 2005/0193792 | A1 | 9/2005 | Yost et al. | |
| 2008/0209716 | A1 * | 9/2008 | Yagi | H01R 43/048 29/753 |
| 2012/0281902 | A1 * | 11/2012 | Oikawa | G01S 7/52034 382/131 |
| 2013/0197823 | A1 | 8/2013 | Williams | |
| 2015/0124558 | A1 * | 5/2015 | Sinha | G01N 29/221 367/7 |

FOREIGN PATENT DOCUMENTS

| | | | |
|---|---|---|---|
| JP | 20117539 | A | 1/2011 |
| WO | 2008 / 013670 | A2 | 1/2008 |
| WO | WO2011042841 | A1 | 4/2011 |
| WO | WO20120060585 | A1 | 3/2012 |

OTHER PUBLICATIONS

International Search Report, International Application No. PCT/US2014/051428, International Filing Date Aug. 18, 2014.

* cited by examiner

FILTERS FOR TERMINAL CRIMPING DEVICES USING ULTRASONIC SIGNALS

BACKGROUND OF THE INVENTION

The subject matter herein relates generally to terminal crimping devices using ultrasonic signals.

Terminals are typically crimped onto wires by means of a conventional crimping press having an anvil for supporting the electrical terminal and a ram that is movable toward and away from the anvil for crimping the terminal. In operation, a terminal is placed on the anvil, an end of a wire is inserted into the ferrule or barrel of the terminal, and the ram is caused to move toward the anvil to the limit of the stroke of the press, thereby crimping the terminal onto the wire. The ram is then retracted to its starting point.

As the crimping process continues some crimps may present quality problems such as missing wires or inadequate contact between the terminal and the wire. Consequently, quality inspections are needed to verify that continued quality crimps are formed. Current crimp quality systems inspect a sample of completed crimps or monitor the crimping process. However, the inspection of samples is time consuming and defects may still not be caught. Additionally, the current crimp monitoring process may not perform well for smaller wires.

New technologies in ultrasonic monitoring have been proposed for use in crimp quality monitoring. For example, U.S. Pat. No. 7,181,942 describes an ultrasonic device and method for measuring crimp connections by transmitting an acoustic signal from a transmitting transducer through the crimp connector to a receiving transducer and processing the signal to indicate the condition of the crimp.

Such ultrasonic monitoring systems are not without disadvantages. For instance, due to the shape of the crimp tooling required to deform the electrical terminal during the crimping process, the ultrasonic signal may be compromised or reduced. Reflected or echoed signals are essentially noise that may distort the signal received by the receiving transducer. The signal reflections may decrease the signal-to-noise ratio of the received signal and reduce the effectiveness of the analysis methods to detect crimp anomalies. Reduction in signal quality reduces the ability to detect quality errors which the ultrasonic monitoring system is designed to detect.

A need remains for a crimp quality monitoring system having improved signal reception at the receiving transducer.

BRIEF DESCRIPTION OF THE INVENTION

In an embodiment, a terminal crimping device is provided that includes crimp tooling comprising an anvil and a ram movable toward the anvil with a crimp zone being defined between the anvil and the ram configured to receive a wire and a terminal configured to be crimped to the wire by the crimp tooling. An ultrasonic transmitting transducer is coupled to at least one of the anvil and the ram that transmits acoustic signals through the wire and terminal. A filter is provided on at least one of the anvil and the ram in the path of the acoustic signals that affects the acoustic signals.

Optionally, the filter may reflect at least some of the acoustic signals. The acoustic signals may be reflected by the filter away from an ultrasonic receiving transducer. The acoustic signals may be reflected by the filter toward an ultrasonic receiving transducer. The filter may focus at least some of the acoustic signals toward an ultrasonic receiving transducer. The filter may focus at least some of the acoustic signals toward the terminal and wire.

Optionally, the filter may be defined by an exterior surface of the crimp tooling. The exterior surface may be angled to direct the acoustic signals in a non-impinging direction relative to an ultrasonic receiving transducer. The exterior surface may have a plurality of angled features directing at least some of the acoustic signals away from the ultrasonic receiving transducer.

Optionally, the filter may include a material of different density than the material of the anvil or ram at the interface with the filter. The filter may include an air pocket. The filter may include one or more openings allowing acoustic signals to pass through the filter in the area of the openings. The filter may be parabolic shaped to focus the acoustic signals on an ultrasonic receiving transducer.

Optionally, the filter may include an absorbing material configured to absorb at least some of the acoustic signals. The absorbing material may be a beryllium material. The filter may transfer at least some of the acoustic signals into surface waves.

In another embodiment, a terminal crimping device is provided that includes crimp tooling comprising an anvil and a ram movable toward the anvil with a crimp zone being defined between the anvil and the ram configured to receive a wire and a terminal configured to be crimped to the wire by the crimp tooling, the anvil having opposite sides with the crimp zone located approximately centered between the sides. An ultrasonic transmitting transducer is coupled to the ram that transmits acoustic signals through the wire and terminal. An ultrasonic receiving transducer receives the acoustic signals sent through the wire and terminal. The ultrasonic receiving transducer is coupled to one of the sides of the anvil offset from a centerline of the anvil. The anvil has a filter directing the acoustic signals toward the ultrasonic receiving transducer at the side of the anvil.

DETAILED DESCRIPTION OF THE INVENTION

Figure 1:
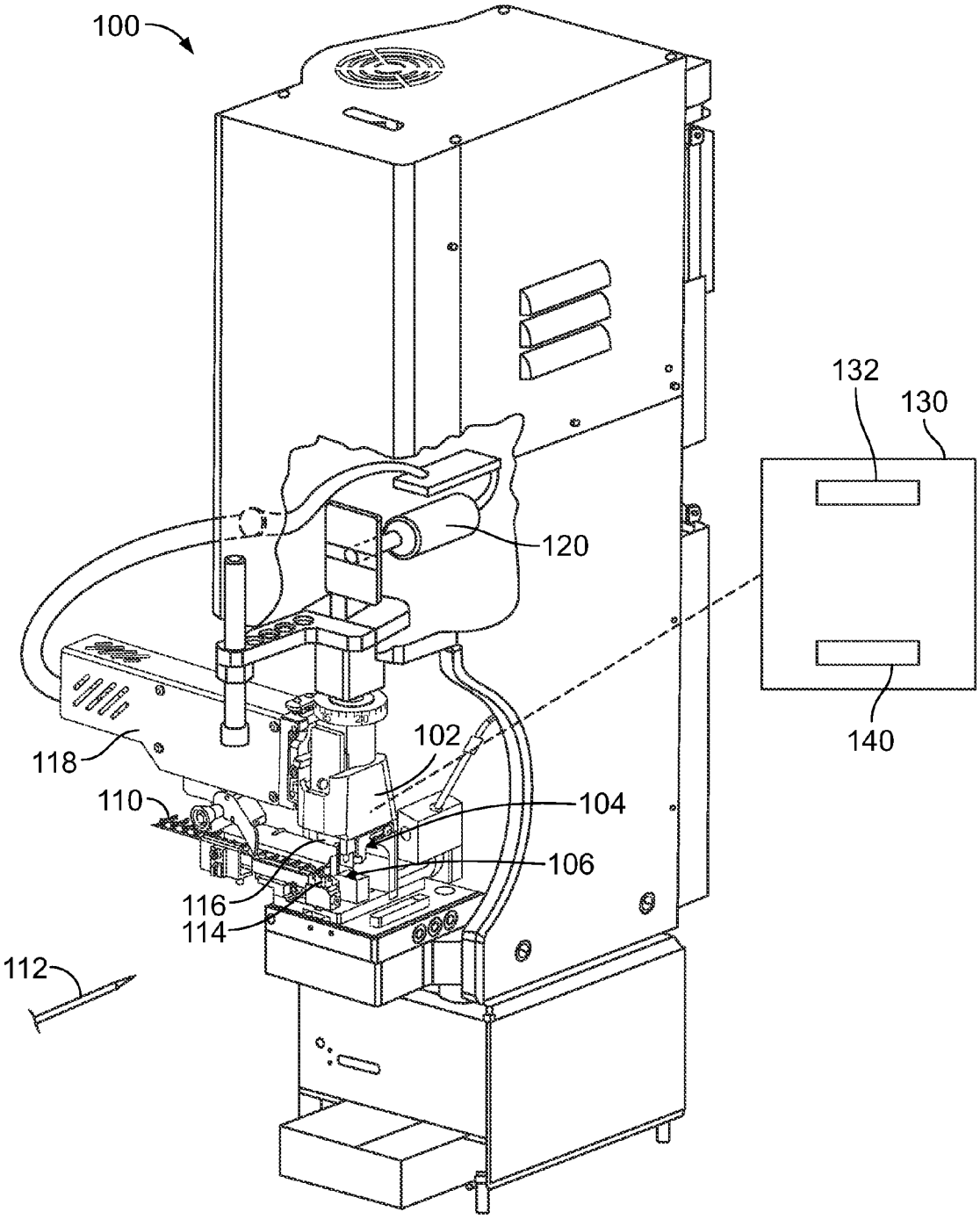
FIG. 1 is a perspective view of a terminal crimping device according to an exemplary embodiment.

FIG. 1 is a perspective view of a terminal crimping device 100 formed in accordance with an exemplary embodiment. The terminal crimping device 100 is used for crimping terminals to wires. In the illustrated embodiment, the terminal crimping device 100 is a bench machine having an applicator 102. Alternatively, the terminal crimping device 100 may be another type of crimping machine, such as a lead maker or a hand tool.

The terminal crimping device 100 includes crimp tooling 104 that is used to form the terminal during the pressing or crimping operation. The terminal crimping device 100 has a terminating zone or crimp zone 106 defined between the crimp tooling 104. Electrical connectors or terminals 110 and an end of a wire 112 are presented in the crimp zone 106 between the crimp tooling 104. In an exemplary embodiment, the crimp tooling 104 used for crimping includes an anvil 114 and a ram 116. The anvil 114 and/or the ram 116 may have removable dies that define the shape or profile of the terminal 110 during the crimping process. In the illustrated embodiment, the anvil 114 is a stationary component of the applicator 102, and the ram 116 represents a movable component. Alternatively, both the ram 116 and the anvil 114 may be movable. For example, with hand tools, typically both halves of the crimp tooling 104 are closed toward each other during the crimping operation.

The terminal crimping device 100 includes a feeder device 118 that is positioned to feed the terminals 110 to the crimp zone 106. The feeder device 118 may be positioned adjacent to the mechanical crimp tooling 104 in order to deliver the terminals 110 to the crimp zone 106. The terminals 110 may be guided to the crimp zone 106 by a feed mechanism to ensure proper placement and/orientation of the terminal 110 in the crimp zone 106. The wire 112 is delivered to the crimp zone 106 by a wire feeder (not shown).

The terminal crimping device 100 may be configured to operate using side-feed type applicators and/or end-feed type applicators. Side-feed type applicators crimp terminals that are arranged side-by-side along a carrier strip, while end-feed type applicators crimp terminals that are arranged successively, end-to-end on a carrier strip. The terminal crimping device 100 may be configured to accommodate both side-feed and end-feed types of applicators, which may be interchangeable within the terminal crimping device 100.

During a crimping operation, the ram 116 of the applicator 102 is driven through a crimp stroke by a driving mechanism 120 of the terminal crimping device 100 initially towards the stationary anvil 114 and finally away from the anvil 114. Thus, the crimp stroke has both a downward component and an upward component. The crimping of the terminal 110 to the wire 112 occurs during the downward component of the crimp stroke. During the crimping operation, a terminal 110 is loaded onto the anvil 114 in the crimp zone 106, and an end of the wire 112 is fed within a crimp barrel of the terminal 110. The ram 116 is then driven downward along the crimp stroke towards the anvil 114. The ram 116 engages the crimp barrel of the terminal 110 and deforms (e.g. folds or rolls) the ends of the crimp barrel inward around the wire 112. The crimp tooling 104 crimps the terminal 110 onto the wire 112 by compressing or pinching the terminal 110 between the ram 116 and the anvil 114. The ram 116 then returns to an upward position. As the ram 116 moves upward, the ram 116 releases or separates from the terminal 110. In an exemplary embodiment, the resilient nature of the terminal 110 and/or wires 112 causes the terminal 110 to rebound slightly from the bottom dead center of the downward portion of the crimp stroke. The elastic yield or spring back of the terminal 110 will follow the ram 116 for a portion of the return or upward part of the stroke of the ram 116 until the terminal 110 reaches a final or stable size. At such point, the terminal 110 has a particular crimp height measured between the bottom and top most points of the terminal 110.

The operation of the terminal crimping device 100 is controlled by a control module 130. For example, the control module 130 may control the operation of the driving mechanism 120. The control module 130 may control the operation of the feeder device 118 and synchronizes the timing of the crimp stroke with the timing of a feed stroke of the feeder device 118. In an exemplary embodiment, the control module 130 includes a crimp quality module 132 that determines a crimp quality of the particular crimp. The terminal 110 may be discarded if the crimp quality does not meet certain specifications. The crimp quality module 132 may determine crimp quality based on characteristics such as the crimp height. In existing systems, the crimp height may be determined based on a measurement of the force or force profile during the crimping process.

In an exemplary embodiment, the control module 130 includes an ultrasound module 140 for transmitting and receiving ultrasonic acoustic signals. Although it is described here as a module separate from module 132, the functions of module 140 and module 132 may be combined into a single module. The ultrasound module 140 may cause acoustic signals to be transmitted through the terminal 110 and the wire 112 during the crimping operation. The crimp quality module 132 may determine crimp quality based on the acoustic signals transmitted through the terminal 110 and the wire 112. The crimp quality module 132 may determine a crimp height of the terminal 110 based on the acoustic signals transmitted through the terminal 110 and the wire 112. The crimp quality module 132 may determine a shape of the crimped terminal based on the acoustic signals transmitted through the terminal 110 and the wire 112. The ultrasound module 140 may cause acoustic signals to be transmitted through the ram 116 and/or the anvil 114 in addition to the terminal 110 and the wire 112 during the crimping operation. For example, in some embodiments, the acoustic signals may be generated at a transducer in the ram 116, transmitted through the ram 116, through the terminal 110, through the wire 112 and through the anvil 114 and then received at a transducer in the anvil 114. In some embodiments, the acoustic signals may be generated at a transducer in the anvil 114, transmitted through the anvil 114, through the terminal 110, through the wire 112 and through the ram 116 and then received at a transducer in the ram 116. In some embodiments, the acoustic signals may be generated at a transducer in the ram 116, transmitted through the ram 116, through the terminal 110, through the wire 112 and then back through the ram 116 and then received at a transducer in the ram 116, which may be the same transducer that generated the acoustic signal. In some embodiments, the acoustic signals may be generated at a transducer in the anvil 114, transmitted through the anvil 114, through the terminal 110, through the wire 112 and then back through the anvil 114 and then received at a transducer in the anvil 114, which may be the same transducer that generated the acoustic signal.

In an exemplary embodiment, the terminal crimping device 100 includes at least one filter 142 (shown in FIG. 2) for filtering the acoustic signals, such as to improve the signal detection for analysis by the crimp quality module 132. The filter 142 may be used to direct or focus the acoustic signals in a particular direction. The filter 142 may be used to direct or focus unwanted portions of the acoustic signals in a particular direction, such as in a non-impinging direction such that the unwanted portions of the acoustic waves are not detected or analyzed. For example, reflections of the acoustic signals may be reduced or minimized, reducing noise received at the receiving transducer.

Figure 2:
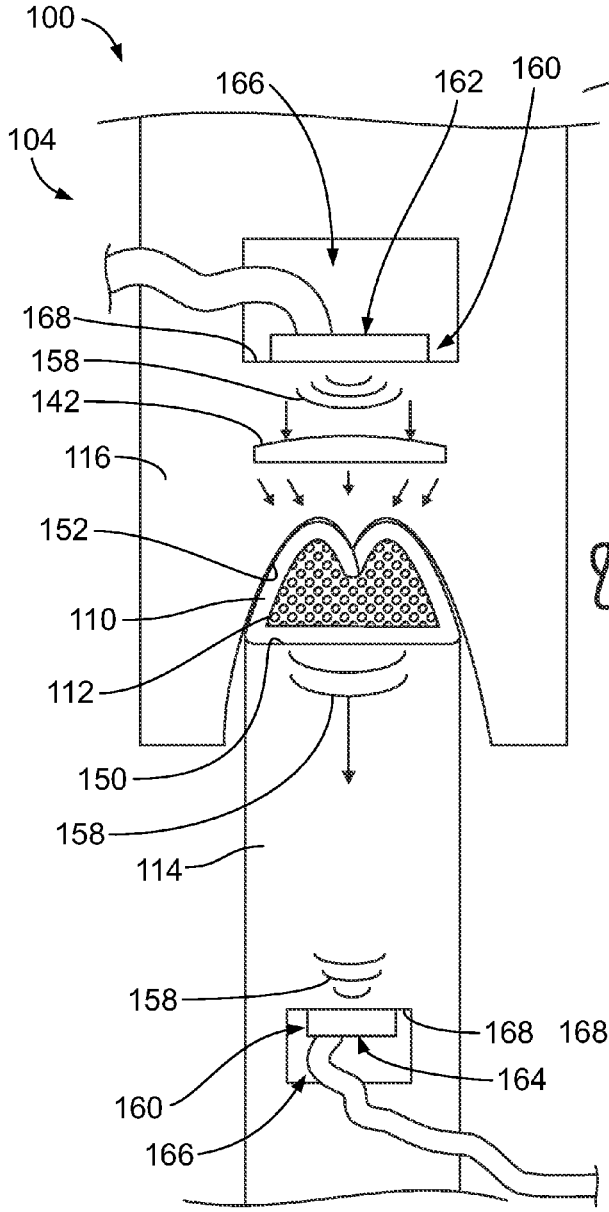
FIG. 2 illustrates a portion of the terminal crimping device showing ultrasonic transducers attached to an anvil and ram with a filter for affecting the acoustic signals transmitted through the device.
Figure 3:
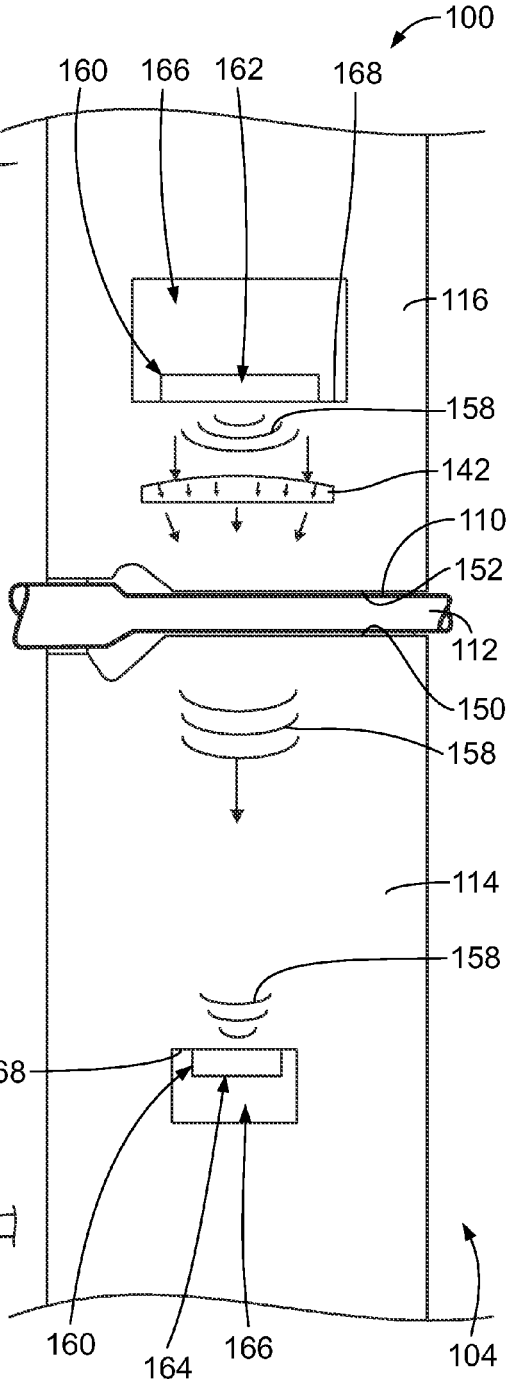
FIG. 3 is a side view of the terminal crimping device shown in FIG. 2.

FIG. 2 illustrates a portion of the terminal crimping device 100 showing the anvil 114 and the ram 116 used to form the crimp during the crimping operation. FIG. 3 is a side view of the crimp tooling 104 with the terminal 110 and wire 112 positioned between the anvil 114 and the ram 116. The crimp tooling 104 may be used to form an open barrel crimp, such as an F-crimp; however other shape crimp tooling may form crimps having other shapes in alternative embodiments.

The anvil 114 has a support surface 150 used to support the terminal 110. In the illustrated embodiment, the support surface 150 is flat and horizontal; however the support surface 150 may have other shapes and/orientations in alternative embodiments. The terminal 110 rests on the support surface 150 as the ram 116 is moved through the crimp stroke.

The ram 116 has a forming surface 152 that engages the terminal 110 during the crimping process. The forming surface 152 presses the sidewalls of the terminal barrel inward during the crimping process. The forming surface 152 compresses the sidewalls against the wire 112 during the crimping process. When the ram 116 is acoustically coupled to the terminal 110, acoustic signals 158 may be transmitted across the forming surface 152 into the terminal 110 and wire 112. The acoustic signals 158 may be transmitted across the support surface 150 into the anvil 114. The acoustic signals 158 may be reflected at the interfaces defined at the forming surface 152 and support surface 150.

In an exemplary embodiment, the ultrasound module 140 (shown in FIG. 1) includes one or more ultrasonic transducers 160 that transmit and/or receive acoustic signals 158 in the ultrasonic frequency range. In the illustrated embodiment, the ultrasound module 140 includes an ultrasonic transmitting transducer 162 and an ultrasonic receiving transducer 164. The ultrasonic transmitting transducer 162 is coupled to the ram 116, while the ultrasonic receiving transducer 164 is coupled to the anvil 114. In other embodiments, the ultrasonic receiving transducer 164 may be coupled to the ram 116 and/or the ultrasonic transmitting transducer 162 may be coupled to the anvil 114. In other embodiments, rather than having dedicated transmitting and receiving transducers, either or both of the transducers 162, 164 may be capable of transmitting and receiving the acoustic signals 158. In other embodiments, only one transducer 162 or 164 is needed that is capable of transmitting and receiving the acoustic signals 158. The ultrasonic transducers 160 may be coupled to an outer surface of the crimp tooling 104. Alternatively, the ultrasonic transducers 160 may be embedded within the crimp tooling 104. For example, the ultrasonic transducers 160 may be arranged within windows or openings 166 in the crimp tooling 104. The ultrasonic transducers 160 are ultrasonically coupled to one or more surfaces 168 of the crimp tooling 104, wherein the acoustic signals 158 may be transmitted to or from the ultrasonic transducers 160 to or from the crimp tooling 104 across the surface(s) 168. The ultrasonic transducers 160 are ultrasonically coupled to the terminal 110 and wire 112 via the crimp tooling 104.

In an exemplary embodiment, the ultrasonic transducers 160 are piezoelectric transducers that convert electrical energy into sound or convert sound waves into electrical energy. The piezoelectric transducers change size when a voltage is applied thereto. The ultrasound module 140 includes electric circuitry coupled to the ultrasonic transmitting transducer 162 to supply an alternating current across the ultrasonic transducer 162 to cause oscillation at very high frequencies to produce very high frequency sound waves. The ultrasonic receiving transducer 164 generates a voltage when force is applied thereto from the acoustic signals 158 and the electric signal generated at the ultrasonic receiving transducer 164 is transmitted by electric circuitry coupled thereto to the ultrasound module 140 and/or the crimp quality module 132 (shown in FIG. 1). Other types of ultrasonic transducers 160 other than piezoelectric transducers may be used in alternative embodiments, such as magnetostrictive transducers.

In an exemplary embodiment, the ultrasound module 140 is used to determine crimp quality characteristics of the crimped terminal, such as the crimp height of the formed wire 112 and terminal 110, by generating the ultrasonic acoustic signal 158 at the transmitting transducer 162. The acoustic signal 158 travels through the crimp tooling 104 and crimped terminal 110 and wire 112 in the form of a longitudinal sound wave, however the wave may be propagated in any direction. The ultrasonic receiving transducer 164 receives the acoustic signal 158 and converts such signal to an electrical signal for processing, such as by the crimp quality module 132. Such process may be repeated approximately 500 or more times per crimp cycle. The filter 142 is used to filter the acoustic signals 158. The filter 142 is positioned in the path of the acoustic signals 158 and affects the acoustic signals 158 in some manner to improve the signal received by the ultrasonic receiving transducer 164. The filter 142 may increase the signal-to-noise ratio of the received acoustic signals at the receiving transducer 164.

In the illustrated embodiment, the filter 142 is on the ram 116 in the path of the acoustic signals 158 between the transmitting transducer 162 and the terminal 110. The filter 142 focuses the acoustic signal 158 toward the terminal 110 and wire 112. The filter 142 focuses the acoustic signals 158 toward the anvil 114 and the receiving transducer 164. In an exemplary embodiment, the filter 142 is shaped to reflect the acoustic signals 158 in a direction toward the terminal 110 to reduce scattering of the acoustic signals 158. Optionally, the filter 142 may be a collimator that causes the spatial cross section of the acoustic signals 158 to become smaller. The acoustic signals 158 are altered as the acoustic waves pass through the filter 142. The filter 142 may be shaped to focus the acoustic signals 158 in a particular direction.

In an exemplary embodiment, the filter 142 is a slug of material in the ram 116 that has a different density than the material of the ram 116 around the filter 142 to focus the acoustic signals 158. For example, when the acoustic signals 158 pass through the filter 142, the filter 142 changes the shape of the wave pattern to focus the acoustic signals 158 in a certain direction, such as toward the terminal 110 and/or the receiving transducer 164. Optionally, the ram 116 may be manufactured from a stainless steel material while the filter 142 is manufactured from a different material, such as an aluminum material, a brass material, a lead material or another material.

Figure 4:
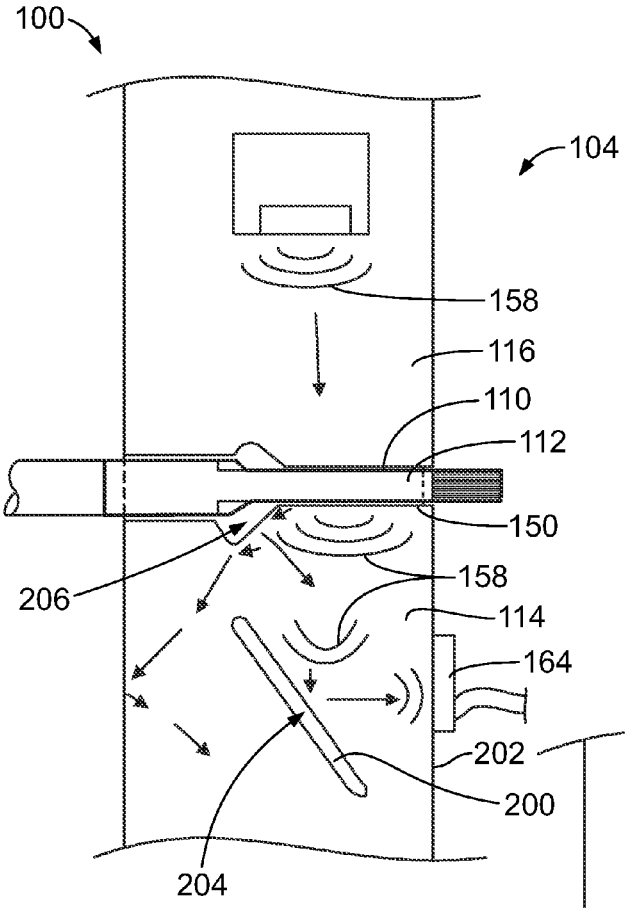
FIG. 4 is a side, partial sectional view of a portion of the terminal crimping device showing a filter for affecting the acoustic signals transmitted through the device.

FIG. 4 is a side, partial sectional view of a portion of the terminal crimping device 100 showing the terminal 110 and wire 112 between the anvil 114 and ram 116. FIG. 4 illustrates a filter 200 on the anvil 114 as opposed to the filter 142 (shown in FIGS. 2 and 3) on the ram 116. FIG. 4 illustrates the receiving transducer 164 provided on an exterior surface 202 of the anvil 114. The receiving transducer 164 is offset from a centerline of the anvil 114 in the illustrated embodiment, the centerline be defined generally aligned with a centerline of the crimped terminal.

The filter 200 is used to reflect the acoustic signals 158 toward the receiving transducer 164. Using the filter 200 to reflect the acoustic signals 158 toward the exterior surface 202 allows the receiving transducer 164 to be positioned along the exterior surface 202, which may be a more convenient mounting location as compared to the opening 166 (shown in FIG. 2).

In an exemplary embodiment, the filter 200 is defined by an air gap or slot 204 formed in the anvil 114. The slot 204 is angled to direct the acoustic signals 158 toward the receiving transducer 164. The filter 200 is defined by an area of alternate density as compared to the material of the anvil 114 surrounding the filter 200. For example, in an exemplary embodiment, the anvil 114 is manufactured of stainless steel material while the filter 200 is air. When the acoustic signal 158 intersect with the transition between stainless steel material of the anvil 114 and the air of the slot 204, the acoustic signals 158 are reflected.

The filter 200 is positioned to intercept a portion of the acoustic signals 158 while some of the acoustic signals 158 bypass the filter 200. The acoustic signals 158 that bypass the filter 200 are not captured by the receiving transducer 164, but rather such acoustic signals 158 are reflected around or beyond the filter 200. The waves that bypass the filter 200 and receiving transducer 164 are typically of lesser analytical significance as such waves are reflected waves or otherwise distorted, such as from the non-uniform crimp tooling shape. Such waves may be echoed or reflected signals off of one or more surfaces of the crimp tooling 104, terminal 110 and/or wire 112. Eliminating such reflected or distorted waves increases the signal strength or quality of the signals received at the receiving transducer 164 for analysis by the crimp quality module 132 (shown in FIG. 1).

In an exemplary embodiment, the support surface 150 of the anvil 114 includes a step 206 generally at the interface between the wire crimp and the insulation crimp of the terminal 110. The step provides an area for the terminal 110 to transition. The step 206 may create reflections or distortions of the acoustic waves passing through the anvil 114. The filter 200 may be positioned to insure that the reflected or distorted waves from the step 206 are not reflected toward the receiving transducer 164. Reducing the amplitude of the reflections increases the overall percentage of the received signal attributable to the initial transmitted wave passing through the crimped terminal. A better signal may be received and analyzed by the receiving transducer 164 and crimp quality module 132 (shown in FIG. 1). The signal-to-noise ratio of the received acoustic signals at the receiving transducer 164 may be increased.

Figure 5:
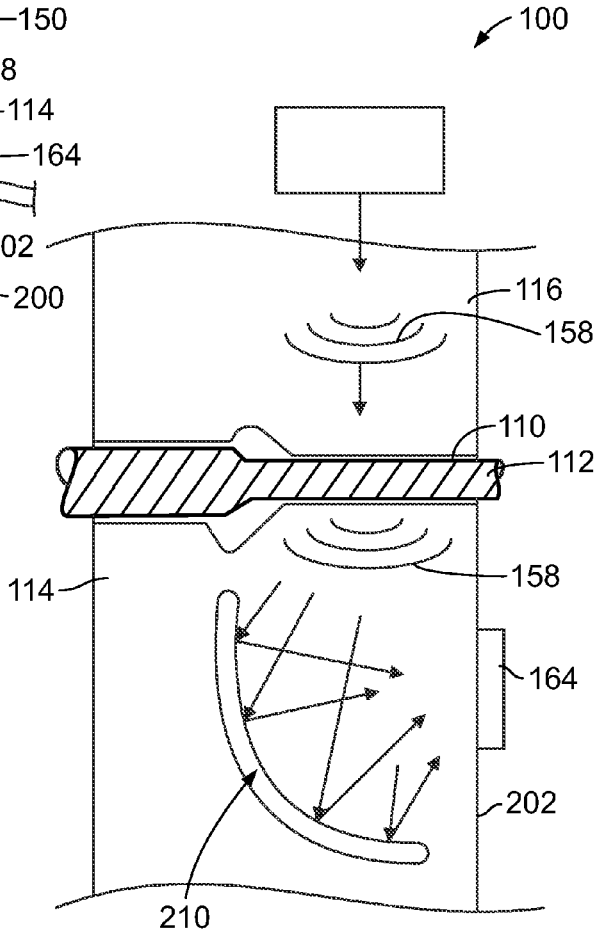
FIG. 5 is a side, partial sectional view of a portion of the terminal crimping device showing a filter for affecting the acoustic signals transmitted through the device.

FIG. 5 is a side, partial sectional view of a portion of the terminal crimping device 100 showing the terminal 110 and wire 112 between the anvil 114 and ram 116. FIG. 5 illustrates a filter 210 similar to the filter 200 (shown in FIG. 4); however the filter 210 has a curved shape. In the illustrated embodiment, the filter 210 has a parabolic shape to focus the ultrasonic signals 158 toward the receiving transducer 164. The filter 210 may be a continuous shape or may be a series of flat or curved segments arranged in a generally parabolic shape. The receiving transducer 164 is provided on the exterior surface 202 of the anvil 114.

The filter 210 is used to reflect the acoustic signals 158 toward the receiving transducer 164. The filter 210 is defined by an area of alternate density as compared to the material of the anvil 114 surrounding the filter 210. For example, in an exemplary embodiment, the anvil 114 is manufactured of stainless steel material while the filter 210 is air.

Figure 6:
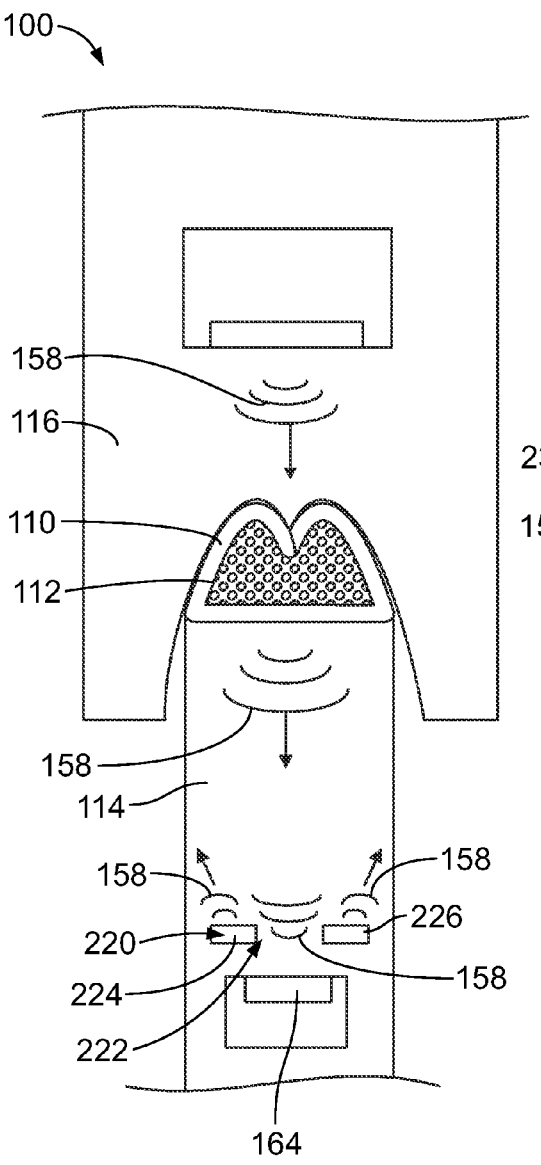
FIG. 6 is a partial sectional view of a portion of the terminal crimping device showing a filter for affecting the acoustic signals transmitted through the device.

FIG. 6 is a partial sectional view of a portion of the terminal crimping device 100 showing the terminal 110 and wire 112 between the anvil 114 and ram 116. FIG. 6 illustrates a filter 220 positioned near the receiving transducer 164. The receiving transducer 164 is shown in a similar location as shown in FIGS. 2 and 3 on the anvil 114.

The filter 220 includes a gap or opening 222 between a pair of filter elements 224, 226. Any number of openings 222 and filter elements 224, 226 may be provided in alternative embodiments. The filter 220 is used to reflect some acoustic signals 158 away from the receiving transducer 164, while some acoustic signals 158 pass through the opening 222 and are received at the receiving transducer 164. The filter 220 is defined by an area of alternate density as compared to the material of the anvil 114 surrounding the filter 220. For example, in an exemplary embodiment, the anvil 114 is manufactured of stainless steel material while the filter elements 224, 226 are air pockets. Such a configuration of the filter 220 blocking some acoustic signals 158 allows the strongest acoustic signals to pass to the receiving transducer 164 while distorted or reflected acoustic signals in the anvil 114 tend to be blocked by the filter 220 or pass around the filter 220 and around the receiving transducer 164 such that the distorted or reflected signals are not received by the receiving transducer 164. Reducing the amplitude of the reflections increases the overall percentage of the received signal attributable to the initial transmitted wave passing through the crimped terminal. A better signal may be received and analyzed by the receiving transducer 164 and crimp quality module 132 (shown in FIG. 1). The signal-to-noise ratio of the received acoustic signals at the receiving transducer 164 may be increased.

Figure 7:
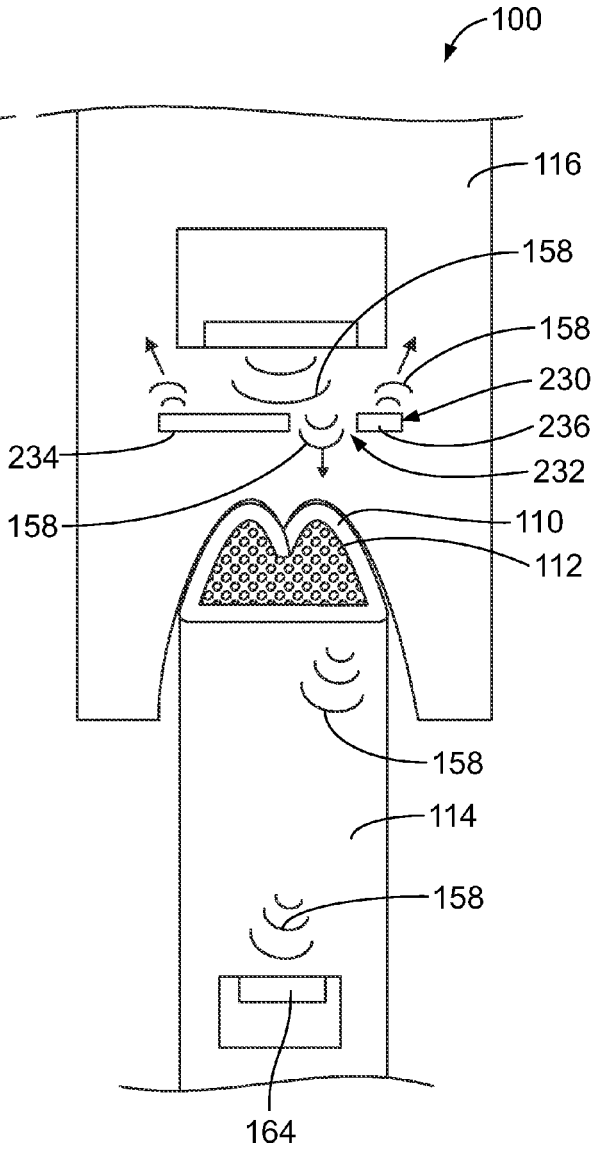
FIG. 7 is a partial sectional view of a portion of the terminal crimping device showing a filter for affecting the acoustic signals transmitted through the device.

FIG. 7 is a partial sectional view of a portion of the terminal crimping device 100 showing the terminal 110 and wire 112 between the anvil 114 and ram 116. FIG. 7 illustrates a filter 230 positioned between the terminal 110 and the transmitting transducer 162, such as in a similar location as the filter 142 (shown in FIGS. 2 and 3).

The filter 230 includes a gap or opening 232 between a pair of filter elements 234, 236. Any number of openings 232 and filter elements 234, 236 may be provided in alternative embodiments. In an exemplary embodiment, the opening 232 is aligned with a certain area of the terminal 110, such as one of the peaks of the crimped terminal 110 to focus the acoustic signals 158 on such area of the terminal 110 as opposed to other areas of the terminal 110, such as the valley of the crimped terminal 110. As the acoustic signals 158 pass through the crimped terminal, a cleaner signal may be received by the receiving transducer 164 as the acoustic signals pass through an area of the terminal 110 having a more uniform geometry leading to less distortion, reflection and echoes. Focusing the acoustic signals 158 through the tallest portion of the crimped terminal 110 may lead to more accurate crimp height measurements. In alternative embodiments, the acoustic signals 158 may be focused at other portions of the crimped terminal using precisely positioned openings 232, such as openings aligned with the valley of the crimped terminal or other portions of the crimped terminal.

The filter 230 is used to reflect some acoustic signals 158 away from the receiving transducer 164, while some acoustic signals 158 pass through the opening 232 and onto the terminal and receiving transducer 164. The filter 230 is defined by an area of alternate density as compared to the material of the ram 116 surrounding the filter 230. For example, in an exemplary embodiment, the ram 116 is manufactured of stainless steel material while the filter elements 234, 236 are air pockets. Such a configuration of the filter 230 blocking some acoustic signals 158 allows a narrower band of acoustic signals to pass to the terminal 110 and receiving transducer 164 while wider bands of the acoustic signals are reflected, reducing the number of echoed waves in the terminal 110, ram 116 and anvil 114 passed to the receiving transducer 164. Reducing the amplitude of the reflections increases the overall percentage of the received signal attributable to the initial transmitted wave passing through the crimped terminal. A better signal may be received and analyzed by the receiving transducer 164 and crimp quality module 132 (shown in FIG. 1). The signal-to-noise ratio of the received acoustic signals at the receiving transducer 164 may be increased.

Figure 8:
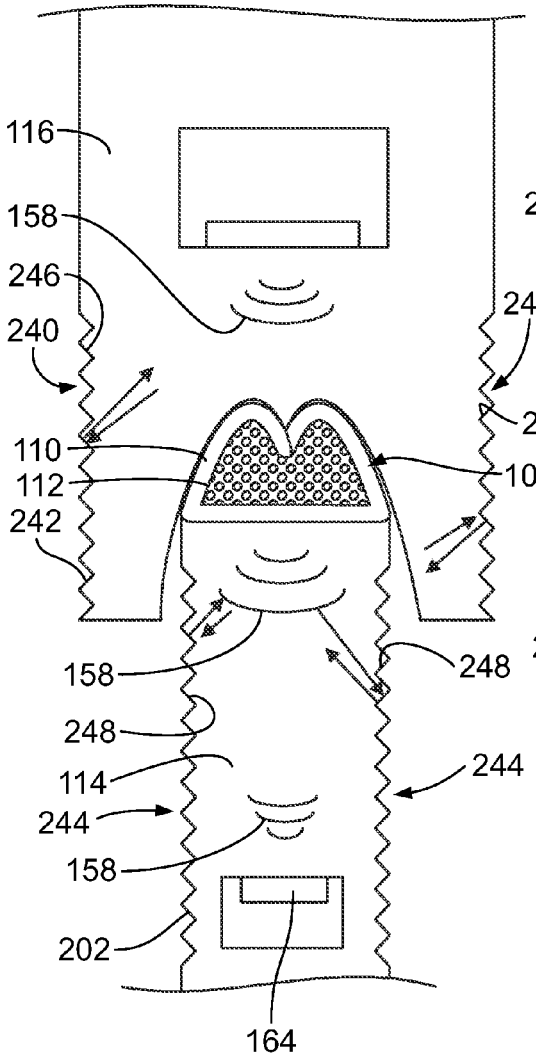
FIG. 8 is a partial sectional view of a portion of the terminal crimping device showing a filter for affecting the acoustic signals transmitted through the device.

FIG. 8 is a partial sectional view of a portion of the terminal crimping device 100 showing the terminal 110 and wire 112 between the anvil 114 and ram 116. FIG. 8 illustrate filters 240 on an exterior surface 242 of the ram 116 and filters 244 on the exterior surface 202 of the anvil 116. The filters 240, 244 are defined by an area of alternate density as compared to the material of the ram 116 and anvil 114, respectively. For example, outside or exterior of the filters 240, 244 is air, while inside or interior of the filters 240, 244 is the metal material (e.g. stainless steel) of the ram 116 and anvil 114.

The filters 240, 244 may include anechoic features to reduce or eliminate echoed waves that are received at the receiving transducer 164. For example, the filters 240, 244 include angled features 246, 248, respectively used to direct at least some of the acoustic signals 158 away from the receiving transducer 164. The angled features 246, 248 are notches or groves formed in the exterior surfaces 242, 202, respectively. The notches may be cut, chemical etched, laser etched, engraved or otherwise formed in the exterior surfaces 242, 202. The filters 240, 244 are used to reflect at least some of the acoustic signals 158 away from the receiving transducer 164. For example, the filters 240, 244 may reflect the acoustic signals 158 back toward the transmitting transducer 162. The filters 240, 244 are angled to direct the acoustic signals 158 in non-impinging directions relative to the receiving transducer 164. The filters 240 reduce the reflected energy, such as echoed signals, that reaches the crimp zone 106. The filters 244 reduce the reflected energy, such as echoed signals, that reaches the receiving transducer 164. Reducing the amplitude of the reflections increases the overall percentage of the received signal attributable to the initial transmitted wave passing through the crimped terminal. A better signal may be received and analyzed by the receiving transducer 164 and crimp quality module 132 (shown in FIG. 1). The signal-to-noise ratio of the received acoustic signals at the receiving transducer 164 may be increased.

Figure 9:
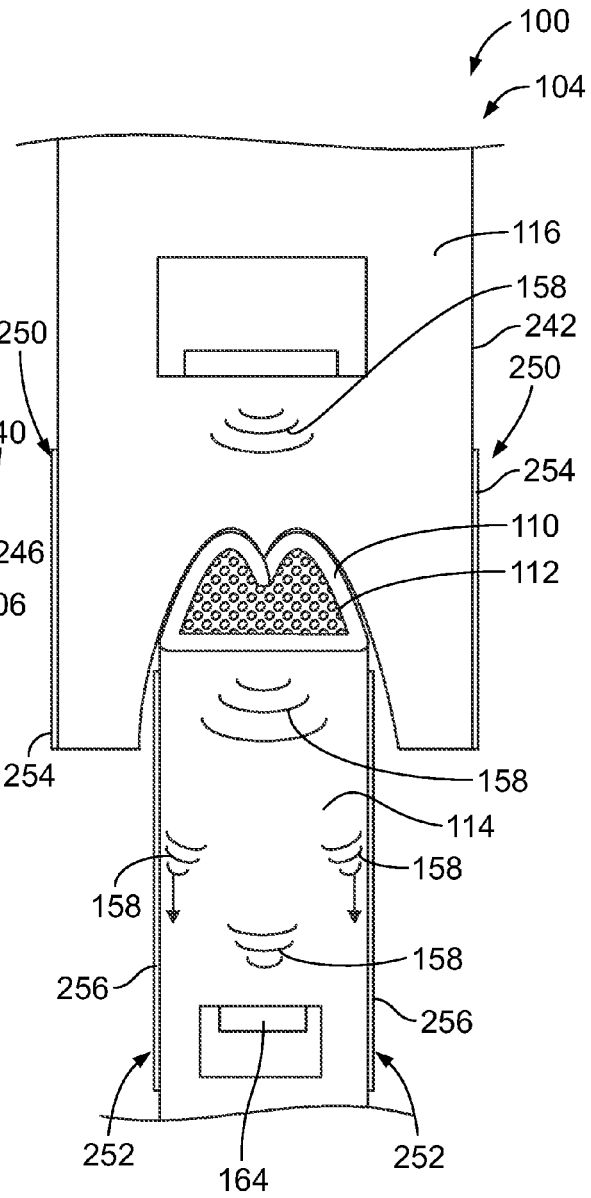
FIG. 9 is a partial sectional view of a portion of the terminal crimping device showing a filter for affecting the acoustic signals transmitted through the device.

FIG. 9 is a partial sectional view of a portion of the terminal crimping device 100 showing the terminal 110 and wire 112 between the anvil 114 and ram 116. FIG. 9 illustrate filters 250 on the exterior surface 242 of the ram 116 and filters 252 on the exterior surface 202 of the anvil 116. In an exemplary embodiment, the filters 250, 252 include absorbing material 254, 256 on the exterior surfaces 242, 202. The absorbing material 254, 256 may define anechoic features of the filters 250, 252. The absorbing material 254, 256 may be configured to cause waves incident to the exterior surfaces 242, 202 to be absorbed into the surface, such as by converting such energy into surface waves. The absorbing material 254, 256 may be any suitable ultrasonic absorbing material, such as Beryllium, Tungsten, or other suitable ultrasonic absorbing material. The energy may be trapped and dissipated in the interface between the absorbing material 254, 256 and the crimp tooling 104. For example, energy directed at an incident angle greater than a maximum incident angle may be absorbed and/or converted into surface waves. The maximum incident angle may be approximately 30°, however the maximum incident angle may be other angles in alternative embodiments, depending on the type of material used.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. A terminal crimping device comprising:

crimp tooling comprising an anvil and a ram movable toward the anvil, a crimp zone being defined between the anvil and the ram configured to receive a wire and a terminal configured to be crimped to the wire by the crimp tooling, the crimp tooling being movable between a crimping position and a released position, the anvil and the ram crimping the terminal to the wire in the crimping position, at least one of the anvil and the ram being released from the terminal in the released position;

an ultrasonic transmitting transducer coupled to at least one of the anvil and the ram, the ultrasonic transmitting transducer configured to transmit acoustic signals through the wire and terminal in the crimping position by passing the acoustic signals from the corresponding crimp tooling into the terminal; and a filter being positioned inside an outer surface of the anvil or the ram in the path of the acoustic signals between the ultrasonic transmitting transducer and the terminal in the crimping position, the acoustic signals being transmitted from the ultrasonic transmitting transducer through the corresponding crimp tooling to the filter, the filter affecting the acoustic signals.

2. The terminal crimping device of claim 1, wherein the filter reflects at least some of the acoustic signals.

3. The terminal crimping device of claim 2, wherein the acoustic signals are reflected by the filter away from an ultrasonic receiving transducer.

4. The terminal crimping device of claim 2, wherein the acoustic signals are reflected by the filter toward an ultrasonic receiving transducer.

5. The terminal crimping device of claim 1, wherein the filter focuses at least some of the acoustic signals toward an ultrasonic receiving transducer.

6. The terminal crimping device of claim 1, wherein the filter focuses at least some of the acoustic signals toward the terminal and wire.

7. The terminal crimping device of claim 1, wherein the filter includes a material of different density than the material of the anvil or ram around the filter.

8. The terminal crimping device of claim 1, wherein the filter includes an air pocket.

9. The terminal crimping device of claim 1, wherein the filter includes one or more openings allowing acoustic signals to pass through the filter in the area of the openings.

10. The terminal crimping device of claim 1, wherein the filter is parabolic shaped to focus the acoustic signals on an ultrasonic receiving transducer.

11. The terminal crimping device of claim 1, wherein the filter is located remote from an exterior surface of the corresponding anvil or ram containing the filter.

12. A terminal crimping device comprising:

crimp tooling comprising an anvil and a ram movable toward the anvil, a crimp zone being defined between the anvil and the ram configured to receive a wire and a terminal configured to be crimped to the wire by the crimp tooling, the crimp tooling being movable between a crimping position and a released position, the anvil and the ram crimping the terminal to the wire in the crimping position, at least one of the anvil and the ram being released from the terminal in the released position, the anvil having opposite sides with the crimp zone located approximately centered between the sides;

an ultrasonic transmitting transducer coupled to the ram, the ultrasonic transmitting transducer transmitting acoustic signals through the wire and terminal along an acoustic signal path in the crimping position by passing the acoustic signals from the ram into the terminal; and an ultrasonic receiving transducer receiving the acoustic signals sent through the wire and terminal in the crimping position, the ultrasonic receiving transducer coupled to one of the sides of the anvil offset from a centerline of the anvil, wherein the anvil having a filter being positioned inside an outer surface of the anvil and positioned in the acoustic signal path between the ultrasonic transmitting transducer and the ultrasonic receiving transducer, the acoustic signals being transmitted through the terminal and the wire to the filter in the crimping position, the filter directing the acoustic signals toward the ultrasonic receiving transducer at the side of the anvil.

13. The terminal crimping device of claim 12, wherein the filter includes a material of different density than the material of the anvil or ram around the filter.

14. The terminal crimping device of claim 12, wherein the filter includes an air pocket.

15. The terminal crimping device of claim 12, wherein the filter is parabolic shaped to focus the acoustic signals on an ultrasonic receiving transducer.

16. The terminal crimping device of claim 12, wherein the filter is positioned such that at least a portion of the acoustic signals bypass the filter and are not directed toward the ultrasonic receiving transducer by the filter.

* * * * *